US010458698B2

(12) United States Patent
Ham et al.

(10) Patent No.: US 10,458,698 B2
(45) Date of Patent: Oct. 29, 2019

(54) REFRIGERATOR

(71) Applicant: Samsung Electronics Co., Ltd, Gyeonggi-do (KR)

(72) Inventors: Yeon Soo Ham, Seoul (KR); Bu Kil Jeong, Suwon-si (KR); Jong-Woo Han, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/878,307

(22) Filed: Jan. 23, 2018

(65) Prior Publication Data

US 2018/0209209 A1 Jul. 26, 2018

(30) Foreign Application Priority Data

Jan. 23, 2017 (KR) ..... 10-2017-0010530

(51) Int. Cl.

| | |
|---|---|
| ***F25D 23/08*** | (2006.01) |
| ***E06B 7/21*** | (2006.01) |
| ***F25D 23/02*** | (2006.01) |
| ***E05F 1/12*** | (2006.01) |
| ***E06B 5/00*** | (2006.01) |
| ***E06B 7/215*** | (2006.01) |

(52) U.S. Cl.

CPC ..... *F25D 23/087* (2013.01); *E05F 1/1207* (2013.01); *E06B 7/215* (2013.01); *F25D 23/02* (2013.01); *F25D 23/028* (2013.01); *E05Y 2900/31* (2013.01); *E06B 5/00* (2013.01); *F25D 2323/021* (2013.01)

(58) Field of Classification Search

CPC .. F25D 23/028; F25D 23/087; F25D 2323/02; F25D 2323/021; F25D 2400/06; E05Y 2900/31

See application file for complete search history.

(56) References Cited

U.S. PATENT DOCUMENTS 5,411,328 A * 5/1995 You ..... F25D 23/028 312/296
5,975,661 A 11/1999 Jeziorowski et al.
5,975,664 A 11/1999 Banicevic et al.
7,008,032 B2 * 3/2006 Chekal ..... F25D 11/02 312/405

(Continued)

FOREIGN PATENT DOCUMENTS

KR 1999-0077579 A 10/1999
KR 2000-0005932 A 1/2000

(Continued)

OTHER PUBLICATIONS

International Search Report dated Apr. 23, 2018 in connection with International Patent Application No. PCT/KR2018/000335.

*Primary Examiner* — Andrew M Roersma

(57) ABSTRACT

Disclosed herein is a refrigerator. The refrigerator comprising, a housing comprising a storage compartment, a door configured to open or close the storage compartment, a rotating bar provided at the door to be rotatable and configured to be located at a first position when the door opens the storage compartment and to be located at a second position lower than the first position when the door closes the storage compartment, and a guide part provided at the housing and configured to guide rotating of the rotating bar.

18 Claims, 17 Drawing Sheets

(56) References Cited

U.S. PATENT DOCUMENTS

| | | | | |
|---|---|---|---|---|
| 9,134,062 | B2 * | 9/2015 | Jung | F25D 23/028 |
| 2007/0257589 | A1 | 11/2007 | Laible | |
| 2012/0137722 | A1 | 6/2012 | Kim | |
| 2013/0241385 | A1 | 9/2013 | Lee et al. | |
| 2014/0159560 | A1 | 6/2014 | Jung et al. | |
| 2015/0054396 | A1 | 2/2015 | Trulaske, Sr. | |
| 2016/0178268 | A1 | 6/2016 | Jung et al. | |

FOREIGN PATENT DOCUMENTS

| | | | | | |
|---|---|---|---|---|---|
| KR | 10-2005-0119436 | A | | 12/2005 | |
| KR | 10-2005-0119438 | A | | 12/2005 | |
| KR | 10-2006-0075396 | A | | 7/2006 | |
| KR | 100615797 | B1 | | 8/2006 | |
| KR | 10-2006-0119470 | A | | 11/2006 | |
| KR | 10-2006-0128422 | A | | 12/2006 | |
| KR | 10-2009-0066703 | A | | 6/2009 | |
| KR | 10-2009-0066771 | A | | 6/2009 | |
| KR | 10-2009-0074996 | A | | 7/2009 | |
| KR | 10-2009-0080249 | A | | 7/2009 | |
| KR | 10-2011-0015789 | A | | 2/2011 | |
| KR | 10-2011-0015790 | A | | 2/2011 | |
| KR | 10-2011-0015791 | A | | 2/2011 | |
| KR | 10-2011-0137428 | A | | 12/2011 | |
| KR | 10-2012-0030270 | A | | 3/2012 | |
| KR | 10-2012-0039887 | A | | 4/2012 | |
| KR | 10-2013-0119278 | A | | 10/2013 | |
| KR | 10-2013-0130314 | A | | 12/2013 | |
| KR | 10-2013-0130317 | A | | 12/2013 | |
| KR | 10-2014-0074521 | A | | 6/2014 | |
| KR | 20150003641 | A | * | 1/2015 | F25D 23/028 |
| KR | 20150003642 | A | * | 1/2015 | F25D 23/028 |
| KR | 20150003643 | A | * | 1/2015 | F25D 23/028 |
| KR | 20150003645 | A | * | 1/2015 | F25D 23/028 |
| KR | 10-2016-0044516 | A | | 4/2016 | |
| WO | 2009/109878 | A1 | | 9/2009 | |
| WO | 2014/173023 | A1 | | 10/2014 | |

* cited by examiner

REFRIGERATOR

CROSS-REFERENCE TO RELATED APPLICATION

The present application is related to and claims priority to Korean Patent Application No. 10-2017-0010530 filed on Jan. 23, 2017, the disclosure of which is incorporated herein by reference.

TECHNICAL FIELD

Embodiments of the present disclosure relate to a refrigerator, and more particularly, to a refrigerator including a rotating bar provided to be rotatable with respect to a door of the refrigerator.

BACKGROUND

A refrigerator is a home appliance that includes a housing including a storage compartment, a cold air supply device provided to supply cold air to the storage compartment, and a door provided to open and close the storage compartment and keep food fresh.

Generally, the storage compartment includes an open front for inserting or withdrawing food, and the open front of the storage compartment is opened and closed by the door. When the door is opened, cold air in the storage compartment flows out therefrom and warm air outside the storage compartment flows into the storage compartment such that a temperature of the storage compartment may increase.

Since the temperature of the storage compartment has to be maintained within a certain range to keep food fresh, when the temperature of the storage compartment increases, a problem may occur in that, while keeping food fresh, additional energy may be consumed in order to lower the temperature of the storage compartment to a normal temperature.

Meanwhile, a French door refrigerator (hereinafter, referred to as an FDR) may include a rotating bar rotatably coupled to a left door or a right door to prevent cold air from flowing outward through a gap between the left door and right door.

SUMMARY

To address the above-discussed deficiencies, it is a primary object to provide a refrigerator including a rotating bar with a height variable with respect to a housing and according to rotating with respect to a door.

It is another aspect of the present disclosure to provide a refrigerator capable of allowing a rotating bar to be smoothly guided by a guide part even when a position of the rotating bar is changed as the floor on which the refrigerator is disposed is inclined.

Additional aspects of the present disclosure will be set forth in part in the description that follows and, in part, will be obvious from the description, or may be learned by practice of the present disclosure.

In accordance with one aspect of the present disclosure, a refrigerator includes a housing comprising a storage compartment, a door configured to open or close the storage compartment, a rotating bar provided at the door to be rotatable and configured to be located at a first position when the door opens the storage compartment, and to be located at a second position lower than the first position when the door closes the storage compartment, and a guide part provided at the housing and configured to guide rotating of the rotating bar.

The rotating bar may include a hinge member coupled to the door, a body rotatably coupled to the hinge member, and a first elastic member of which one end is connected to the hinge member and another end, opposite to the one end, is connected to the body.

The first elastic member may be disposed to support the body upward with respect to the hinge member.

The rotating bar may include a shaft cover configured to cover a shaft of the hinge member, and the shaft cover may include an incline portion formed to incline downward along a direction in which the rotating bar rotates when pivoting from the first position to the second position.

The hinge member may include a protrusion that radially protrudes from the shaft and slides on the incline portion when the rotating bar rotates.

The first elastic member may be disposed to pressurize the shaft to allow the protrusion to come into contact with the incline portion.

The protrusion may be configured to pressurize a bottom of the incline portion when the rotating bar is located at the first position, and to pressurize a top of the incline portion when the rotating bar is located at the second position.

The shaft cover may be separably coupled to the body.

The hinge member may include an upper hinge member coupled to a top of the door, and the first elastic member may be disposed to allow the one end thereof to be connected to the hinge member to support the body.

The body may include a support that is located in a manner to be connected to another end of the first elastic member, which is opposite to the one end, and is supported by the first elastic member.

The support may include a guide hole configured to guide compression or elongation of the first elastic member.

The rotating bar may include an insertion protrusion guided by the guide part and with at least one part supported so as to protrude outward from the body, and a second elastic member configured to elastically support the insertion protrusion outside the body, and the insertion protrusion may include a protrusion incline formed on one surface that faces the guide part and formed to incline downward toward the guide part when the rotating bar is located at the first position.

The insertion protrusion may be provided to be movable into the body by pressurizing of the guide part when the protrusion incline collides with the guide part.

The rotating bar may include an insertion protrusion guided by the guide part and with at least one part supported so as to protrude outward from the body, and a second elastic member configured to elastically support the insertion protrusion outside the body, and the guide part may include a guide incline formed at one portion where the insertion protrusion enters and formed to incline downward along an entrance direction of the insertion protrusion.

The insertion protrusion may be provided to be movable into the body by pressurizing the guide part when colliding with the guide incline.

In accordance with another aspect of the present disclosure, a refrigerator include a housing comprising a storage compartment, a door configured to open or close the storage compartment, a rotating bar provided at the door to be rotatable and with a height that changes as the door opens or closes the storage compartment, and a guide bar provided at the housing and configured to guide rotating of the rotating bar, wherein the rotating bar includes a shaft cover comprising an incline portion formed to incline downward along a direction in which the rotating bar rotates when the door closes the storage compartment, and a hinge member fixed to the door and comprising a shaft with a protrusion that slides on the incline portion when the rotating bar rotates.

The rotating bar may include a first elastic member configured to pressurize the protrusion in a direction toward the incline portion.

The rotating bar may move downward when the door closes the storage compartment.

The shaft cover may include a level portion formed to be level to stop downward movement of the rotating bar.

In accordance with still another aspect of the present disclosure, a refrigerator include a housing comprising a storage compartment, a door configured to open or close the storage compartment, a rotating bar provided at the door to be rotatable and configured to move downward when the door closes the storage compartment, and to move upward when the door opens the storage compartment, and a guide part configured to guide rotating of the rotating bar.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
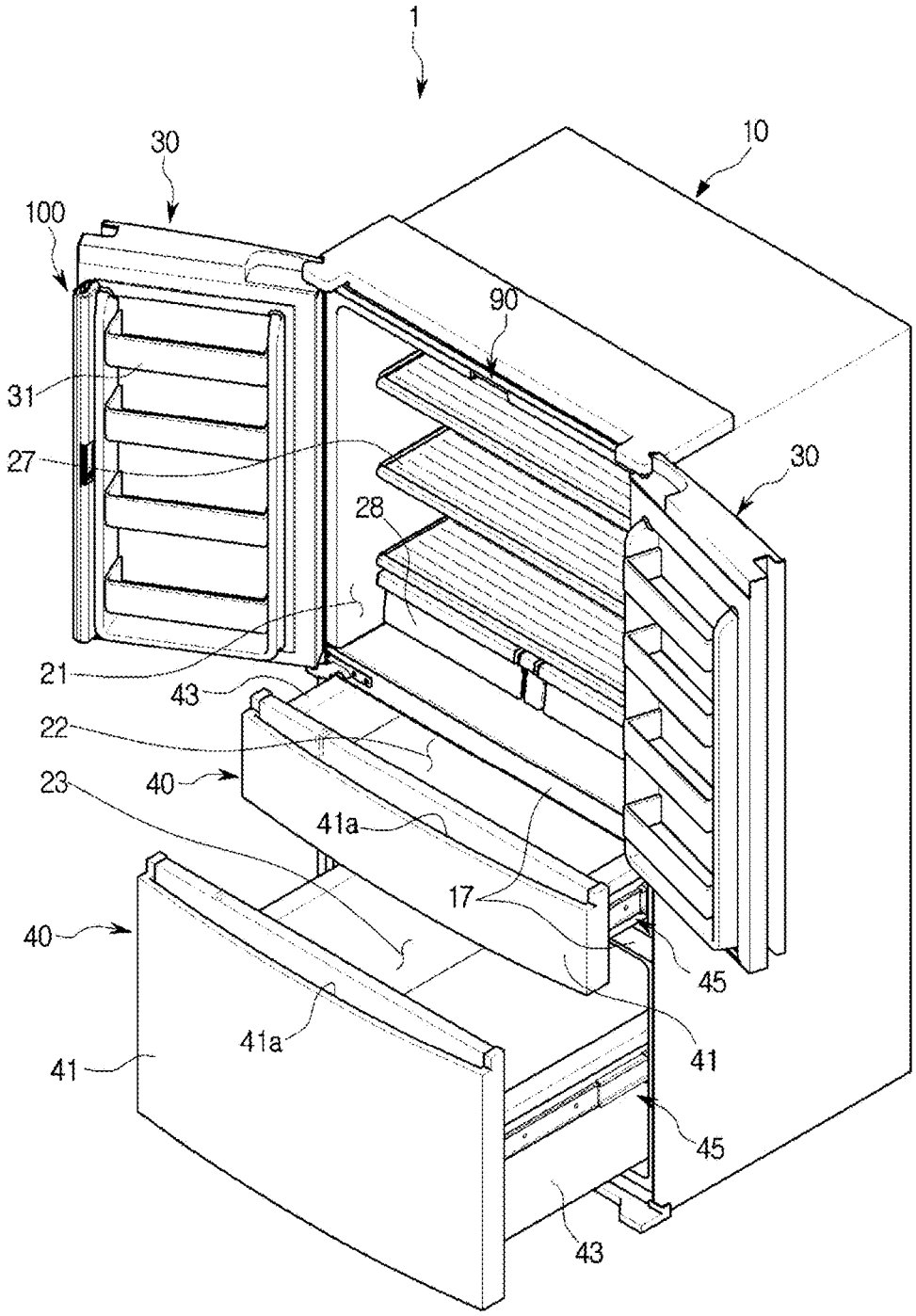
FIG. 1 is a view illustrating a refrigerator according to one embodiment of the present disclosure.

FIGS. 1 through 17, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments disclosed in the specification and the components shown in the drawings are merely preferable examples of the present disclosure and various modifications capable of replacing the embodiments and drawings of the specification may be made at the time of filing the present application.

Also, throughout the drawings of the present specification, like reference numerals or symbols refer to components or elements configured to perform substantially identical functions.

Also, the terms used herein are intended to explain the embodiments but are not intended to limit and/or define the present disclosure. Singular forms, unless defined otherwise in context, include plural forms. Throughout the specification, the terms "comprise", "have", and the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as first, second and the like may be used for describing various components, the components will not be limited by the terms and the terms are used only for distinguishing one component from others. For example, without departing from the scope of the present disclosure, a first component may be referred to as a second component, and similarly, the second component may be referred to as the first component. The term "and/or" includes any and all combinations or one of a plurality of associated listed items.

Meanwhile, the terms "rearward", "above", "below", "a top end", "a bottom end", and the like used below are defined on the basis of the drawings, and shapes and positions of components are not limited thereto.

Hereinafter, the embodiments will be described in detail with reference to the attached drawings.

Figure 2:
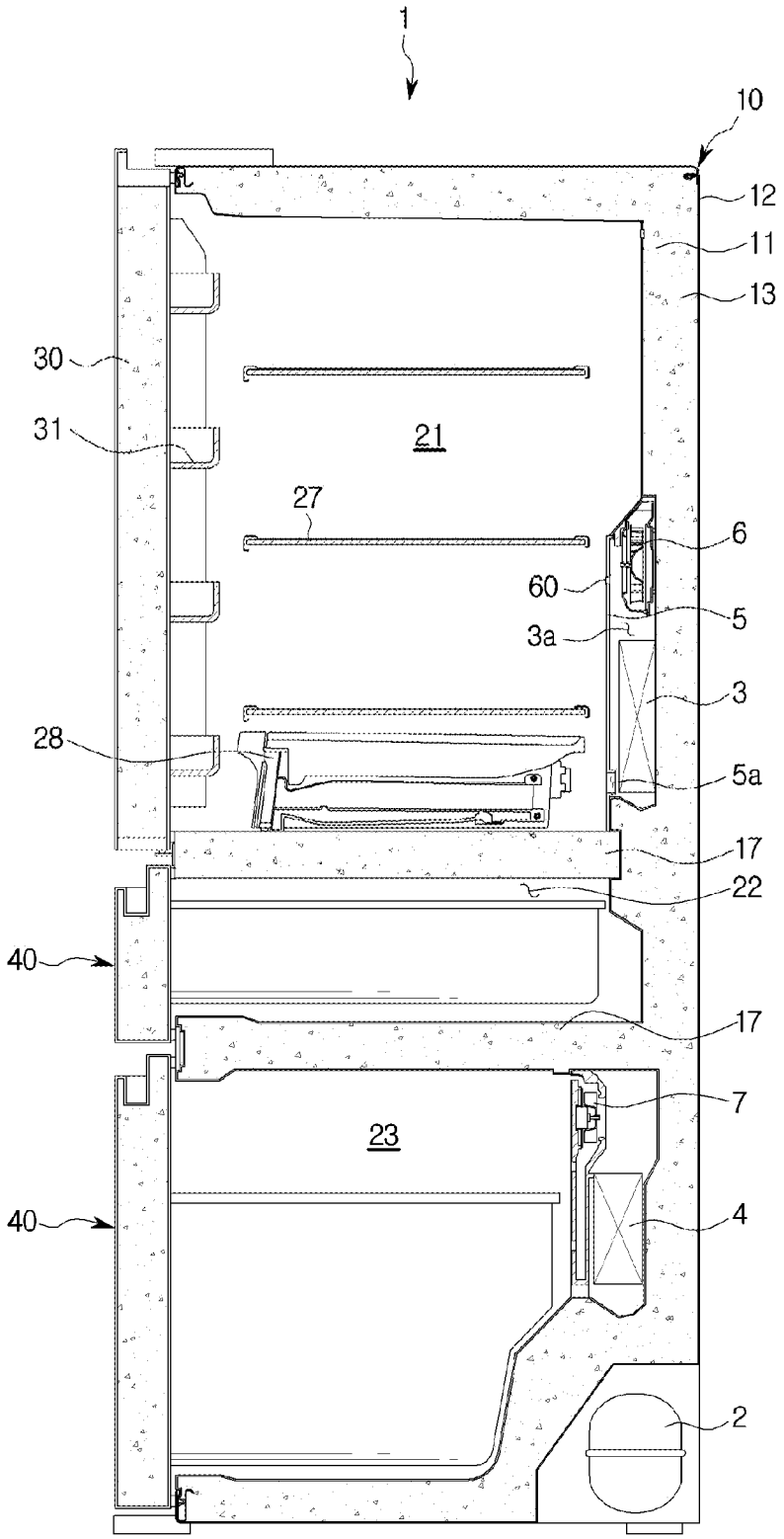
FIG. 2 is a schematic side cross-sectional view of the refrigerator of FIG. 1.

FIG. 1 is a view illustrating a refrigerator 1 according to one embodiment of the present disclosure. FIG. 2 is a schematic side cross-sectional view of the refrigerator 1 of FIG. 1.

Referring to FIGS. 1 and 2, the refrigerator 1 may include a housing 10 that includes storage compartments 21, 22, and 23, doors 30 and 40 provided to open and close the storage compartments 21, 22, and 23, and a cold air supply device that supplies cold air to the storage compartments 21, 22, and 23.

The housing 10 may include an inner casing 11 that forms the storage compartments 21, 22, and 23, an outer casing 12 that is coupled to an outside of the inner casing 11, and an insulator 13 provided between the inner casing 11 and the outer casing 12. The inner casing 11 may be formed by injection-molding a plastic material, and the outer casing 12 may be formed of a metal material. A urethane foam insulation may be used as the insulator 13, and a vacuum insulation panel may be used therewith as necessary. The housing 10 may include an intermediate wall 17 that partitions the storage compartments 21, 22, and 23 into top and bottom compartments.

The storage compartments 21, 22, and 23 may be used as a refrigerator compartment maintained at a temperature of about 0° C. to 5° C. to keep food refrigerated and a freezer compartment maintained at a temperature of about −30° C. to 0° C. to keep food frozen.

The storage compartments 21, 22, and 23 may be provided to have open fronts for inserting and withdrawing food, and the open fronts of the storage compartments 21, 22, and 23 may be opened and closed by the doors 30 and 40. In the storage compartments 21, 22, and 23, a rack 27 capable of having food disposed thereon and storage containers 28 capable of storing food may be provided.

First doors 30 may be provided to open and close a first storage compartment 21. The first doors 30 may be coupled to the housing 10 so as to be rotatable leftward and rightward. Door guards 31 capable of storing food may be provided at rear sides of the doors 30.

A rotating bar 100 may be rotatably mounted on one of the first doors 30 to seal a gap formed between the first doors 30 while the first doors 30 are closed.

The rotating bar 100 has a bar shape formed to be long in a longitudinal direction of the first doors 30 and is rotatable by a guide part 90 provided at the housing 10. The guide part 90 of the housing 10 may include a guide body 91 (refer to FIG. 6) coupled to the housing 10 and a guide groove 92 (refer to FIG. 6) formed at the guide body 91.

In detail, the rotating bar 100 may pivot toward a first position approximately vertical to the first doors 30 when the first doors 30 open the first storage compartment 21. On the other hand, the rotating bar 100 may pivot toward a second position approximately parallel to the first doors 30 when the first doors 30 close the first storage compartment 21. When the first doors 30 open the first storage compartment 21, the rotating bar 100 may be located at the first position. When the first doors 30 close the first storage compartment 21, the rotating bar 100 may be located at the second position at a height different from that of the first position. The second position may be at a height lower than that of the first position. The rotating bar 100 may be configured to be changed in height when the first doors 30 open and close the first storage compartment 21. The rotating bar 100 may be provided to move downward when the first doors 30 close the first storage compartment 21 and to move upward when the first doors 30 open the first storage compartment 21. A configuration and operation of the rotating bar 100 will be described in detail.

Second doors 40 may be slidably provided so as to be insertable into a second storage compartment 22 and a third storage compartment 23 or to be withdrawable outward from the second storage compartment 22 and the third storage compartment 23. The second doors 40 may include door portions 41 that cover open fronts of the second storage compartment 22 and the third storage compartment 23 and baskets 43 coupled to rear sides of the door portions 41. The baskets 43 may be slidably supported by rails 45. The door portions 41 may include handles 41*a*.

The cold air supply device may generate cold air using evaporative latent heat of a refrigerant through a cooling cycle. The cold air supply device may include a compressor 2, a condenser, an expander, evaporators 3 and 4, and air-blowing fans 6 and 7.

A first evaporator 3 may be disposed in the rear of the first storage compartment 21 and may generate cold air. The first evaporator 3 may be accommodated in a cooling chamber 3*a* formed by an evaporator cover 5. The evaporator cover 5 may include an inlet 5*a*, and air may be suctioned into the cooling chamber 3*a* from the first storage compartment 21 through the inlet 5*a*.

A first air-blowing fan 6 may be provided in the cooling chamber 3*a* to move the air. The cooling chamber 3*a* may include a cold air outlet 60 that discharges cold air in the cooling chamber 3*a* into the first storage compartment 21. According to the above configuration, when the first air-blowing fan 6 operates, air may be suctioned into the cooling chamber 3*a* from the first storage compartment 21 through the inlet 5*a*, and the suctioned air may be cooled by the first evaporator 3 and then may be discharged into the first storage compartment 21 through the cold air outlet 60.

Figure 3:
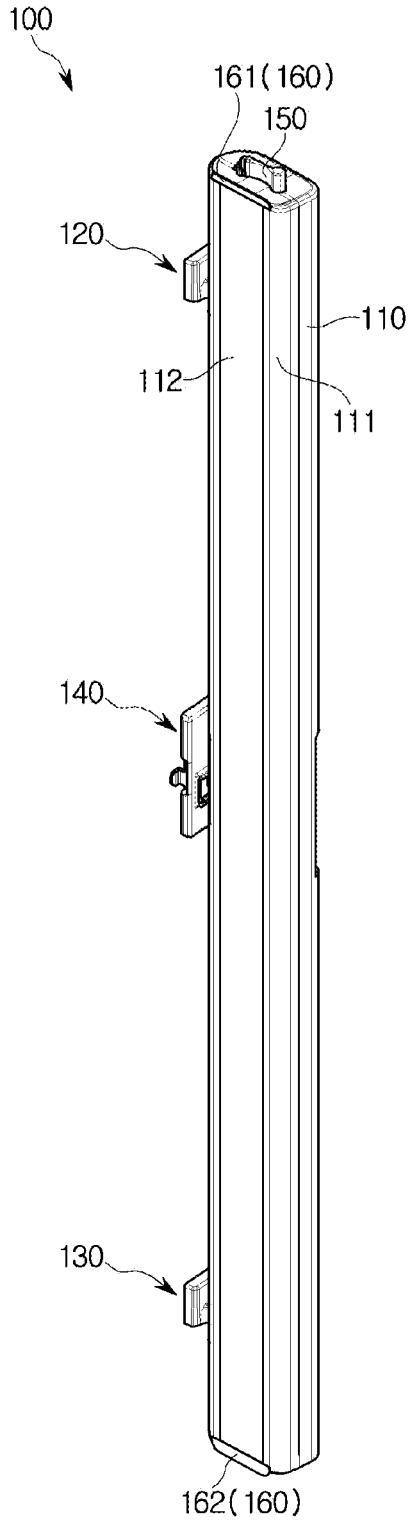
FIG. 3 is a view illustrating the rotating bar shown in FIG. 1.
Figure 4:
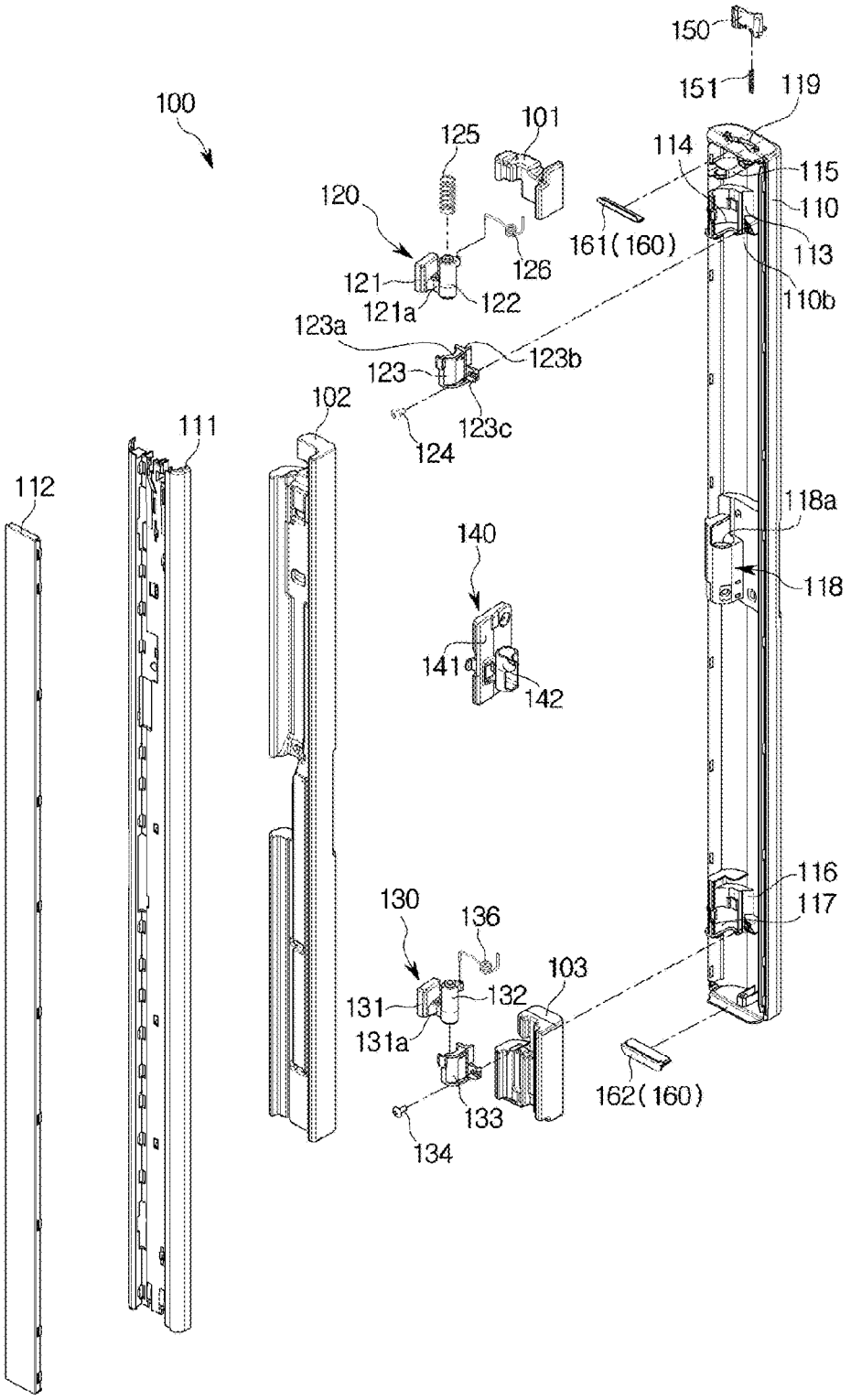
FIG. 4 is an exploded perspective view illustrating a configuration of the rotating bar shown in FIG. 3.
Figure 5:
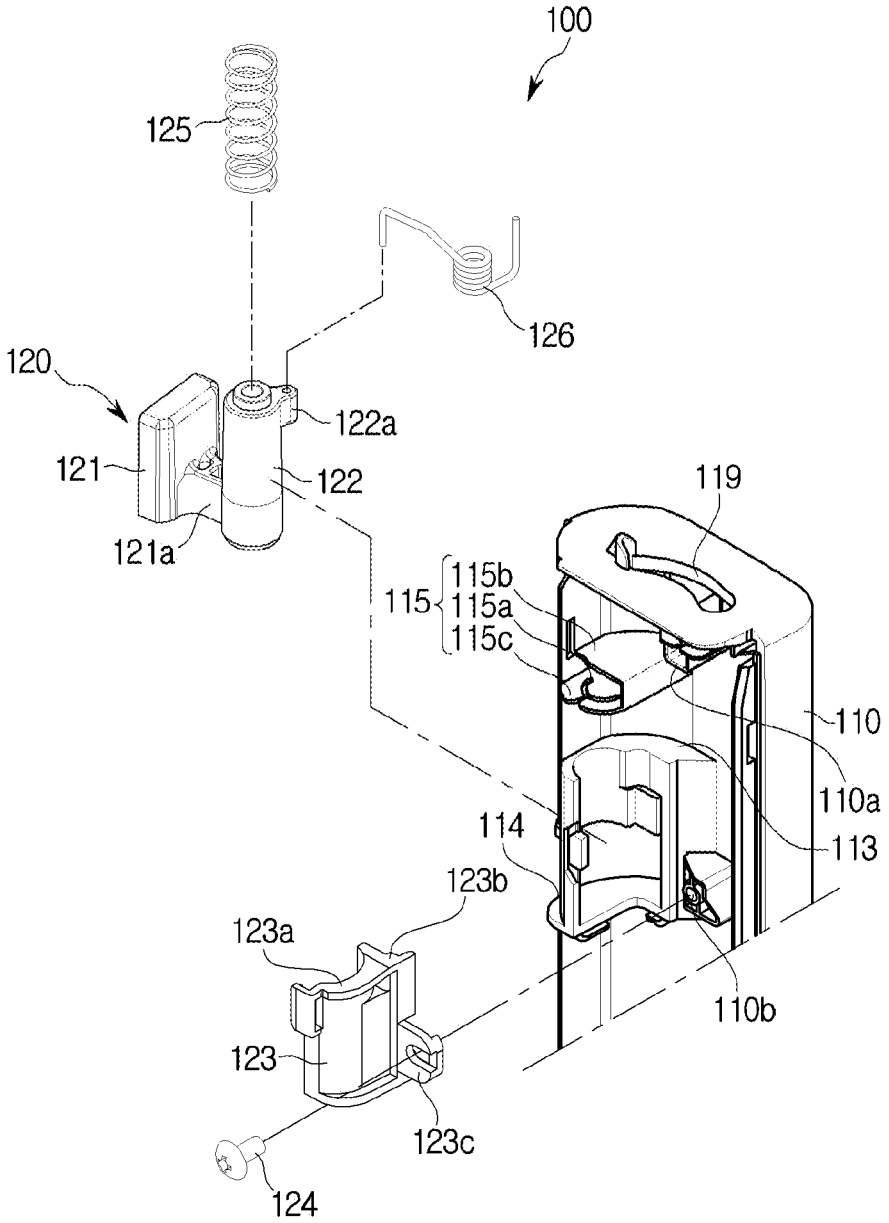
FIG. 5 is a view illustrating a state in which an upper hinge member shown in FIG. 4 is coupled to a body.
Figure 6:
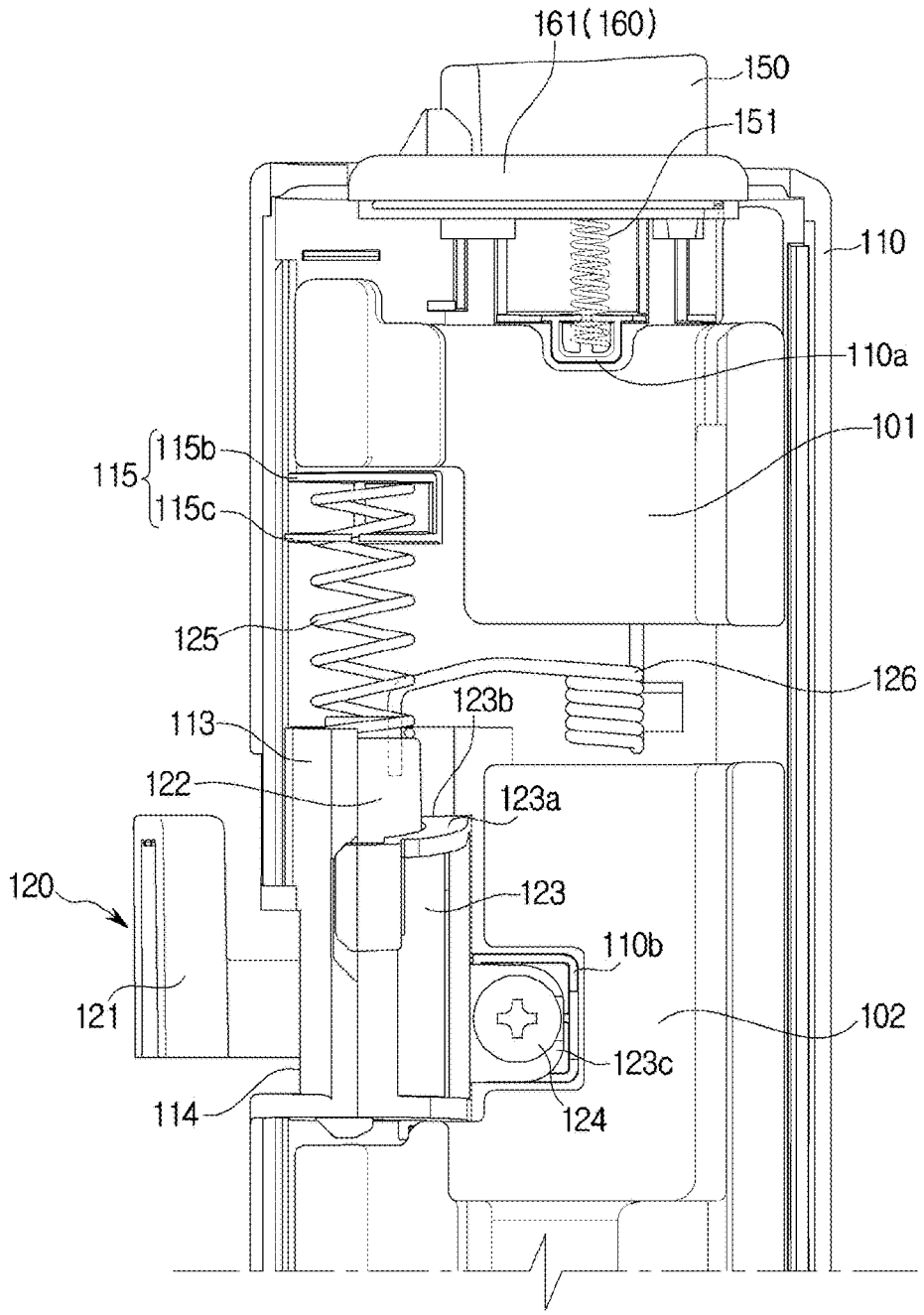
FIG. 6 is a view illustrating an inside of the rotating bar shown in FIG. 3.

FIG. 3 is a view illustrating the rotating bar 100 shown in FIG. 1. FIG. 4 is an exploded perspective view illustrating a configuration of the rotating bar 100 shown in FIG. 3. FIG. 5 is a view illustrating a state in which an upper hinge member 120 shown in FIG. 4 is coupled to a body 110, 111, and 112. FIG. 6 is a view illustrating an inside of the rotating bar 100 shown in FIG. 3.

Referring to FIGS. 3 to 6, the rotating bar 100 may include the body 110, 111, and 112 that includes a case 110 with one open side and with covers 111 and 112 that cover the one open side of the case 110, includes hinge members 120, 130, and 140 that support the body 110, 111, and 112 so as to be rotatable with respect to the first doors 30, and an insertion protrusion 150 guided by the guide part 90 provided at the housing 10. The hinge members 120, 130, and 140 may include the upper hinge member 120, a lower hinge member 130, and an intermediate hinge member 140.

The case 110 may form an exterior of the rotating bar 100 and may include a space therein in which insulation members 101, 102, and 103 are accommodated. The open one side of the case 110 may be covered by a first cover 111 and a second cover 112.

The second cover 112 may include a metal material. A heating member (not shown) may be provided between the first cover 111 and the second cover 112. The heating member may prevent a difference between temperatures inside and outside the storage compartment 21 from frosting up the second cover 112.

The case 110 may include a first hinge accommodation portion 113 to which the upper hinge member 120 is coupled. The upper hinge member 120 is accommodated in the first hinge accommodation portion 113 such that the rotating bar 100 may be rotatably supported by the first doors 30. In detail, the case 110 may pivot clockwise while rotating on the hinge members 120, 130, and 140 from the first position to the second position, and may pivot counterclockwise while rotating from the second position to the first position.

The first hinge accommodation portion 113 may include an upper opening 114 in which an upper connector 121*a* that connects an upper hinge body 121 of the upper hinge member 120 to an upper shaft 122 is disposed. The upper opening 114 may be formed to be a size that does not interfere with the rotating of the case 110 of the rotating bar 100 when the case 110 pivots on the upper hinge member 120.

The case 110 may include a support 115 supported by a first elastic member 125. The support 115 may be connected to an upper end of the first elastic member 125. The support 115 may include a guide hole 115*a* (refer to FIG. 8) that guides compression or elongation of the first elastic member 125. The guide hole 115*a* may be formed to correspond to a shape of the first elastic member 125.

The support 115 may include two plates 115*b* and 115*c* extending from an inner surface of the case 110. The guide hole 115*a* of the support 115 may be formed at the plate 115*c* of the two plates 115*b* and 115*c*, which is disposed below. The support 115 includes the two plates 115*b* and 115*c*, and the guide hole 115*a* is formed at the plate 115*c* disposed below such that the case 110 may be more reliably supported by the first elastic member 125. That is, according to the above configuration, the first elastic member 125 may be prevented from being distorted and from inclining leftward or rightward, i.e., in directions not upward or downward.

The case 110 may include a second hinge accommodation portion 116 to which the lower hinge member 130 is coupled. The lower hinge member 130 is accommodated in the second hinge accommodation portion 116 such that the rotating bar 100 may be rotatably supported by the first doors 30.

The second hinge accommodation portion 116 may include a lower opening 117 in which a lower connector 131*a* that connects a lower hinge body 131 of the lower hinge member 130 to a lower shaft 132 is disposed. The lower opening 117 may be formed to be a size that does not interfere with the rotating of the case 110 of the rotating bar 100 when the case 110 pivots on the lower hinge member 130.

The case 110 may include a third hinge accommodation portion 118 to which the intermediate hinge member 140 is coupled. The intermediate hinge member 140 is accommodated in the third hinge accommodation portion 118 such that the rotating bar 100 may be rotatably supported by the first doors 30. The third hinge accommodation portion 118 may include an insertion hole 118*a* into which an intermediate shaft 142 of the intermediate hinge member 140 is inserted so as to be rotatable and vertically slidable.

The case 110 may include a through hole 119 through which the insertion protrusion 150 that will be described below passes. The insertion protrusion 150 may at least partially protrude outward from the case 110 through the through hole 119. The through hole 119 may be formed to have a shape similar to a shape of the insertion protrusion 150.

The upper hinge member 120 may have the upper hinge body 121 fixed to one of the first doors 30, to the upper shaft 122 inserted into the first hinge accommodation portion 113 so as to be rotatable and vertically slidable, and to the upper connector 121*a* that connects the upper hinge body 121 to the upper shaft 122.

The upper hinge body 121 may be fixed to a top of one of the first doors 30 rotatably coupled to left and right sides of the housing 10. The upper connector 121*a* may extend from the upper hinge body 121. The upper shaft 122 may be provided at another end of the upper connector 121*a*, opposite to one end thereof connected to the upper hinge body 121, and may vertically extend a certain length.

The upper shaft 122 may include a protrusion 122*a* that radially protrudes with respect to a rotating shaft of the case 110. The protrusion 122*a* may slide on an incline portion 123*a* and/or a level portion 123*b* of an upper shaft cover 123 that will be described below. A bottom surface of the protrusion 122*a* may come into contact with a top surface of the incline portion 123*a* and/or the level portion 123*b*.

The rotating bar 100 may include the upper shaft cover 123 for covering the upper shaft 122 accommodated in the first hinge accommodation portion 113. The upper shaft cover 123 may be coupled to the case 110 by a first coupling member 124. The upper shaft cover 123 may be separably coupled to the case 110.

In detail, the upper shaft cover 123 may include an upper coupler 123*c*, and the first coupling member 124 may pass through the upper coupler 123*c* and an upper cover coupler 110*b* formed at the case 110 and may fix the upper shaft cover 123 to the case 110.

The upper shaft cover 123 may rotatably and slidably support the upper shaft 122 with the first hinge accommodation portion 113 of the case 110. The upper shaft cover 123 and the first hinge accommodation portion 113 may together form a coupling hole with a size corresponding to a size and/or shape of the upper shaft 122.

The upper shaft cover 123 may include the incline portion 123*a* formed at a top surface to incline downward and frontward when the rotating bar 100 is at the second position. That is, the upper shaft cover 123 may include the incline portion 123*a* that inclines downward in a direction in which the rotating bar 100 pivots when rotating from the first position to the second position. The incline portion 123*a* may be pressurized by the protrusion 122*a* of the upper hinge member 120 so as to be decreased in height when the rotating bar 100 pivots from the first position to the second position. The upper shaft cover 123 may include the level portion 123*b* formed to be approximately flat.

Figure 7:
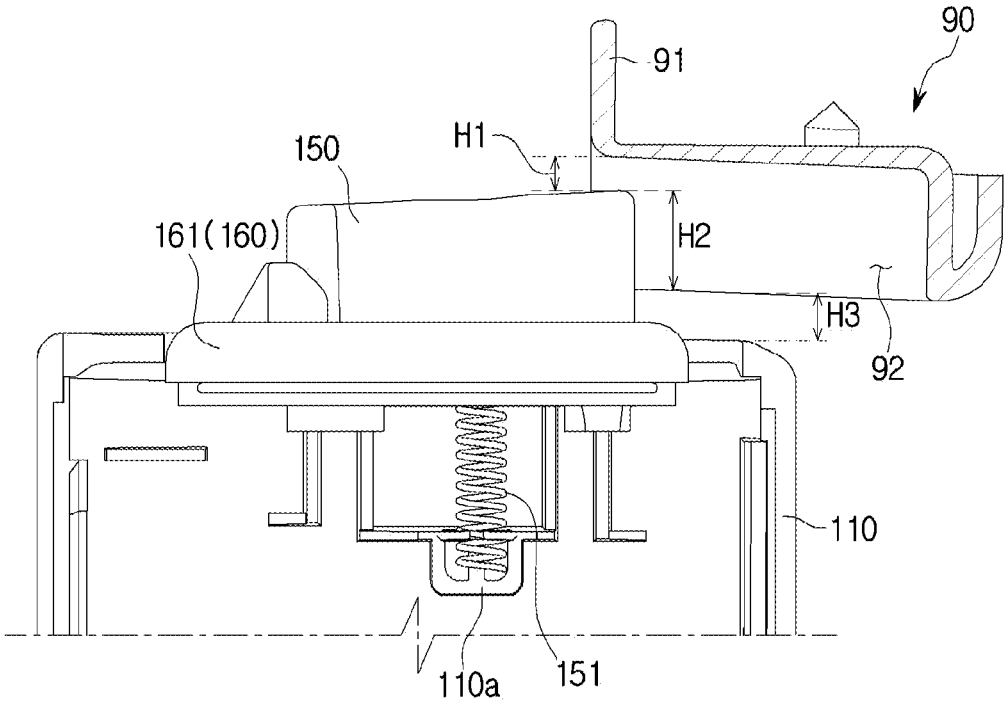
FIG. 7 is a view illustrating a state in which the rotating bar shown in FIG. 3 enters the guide part.
Figure 8:
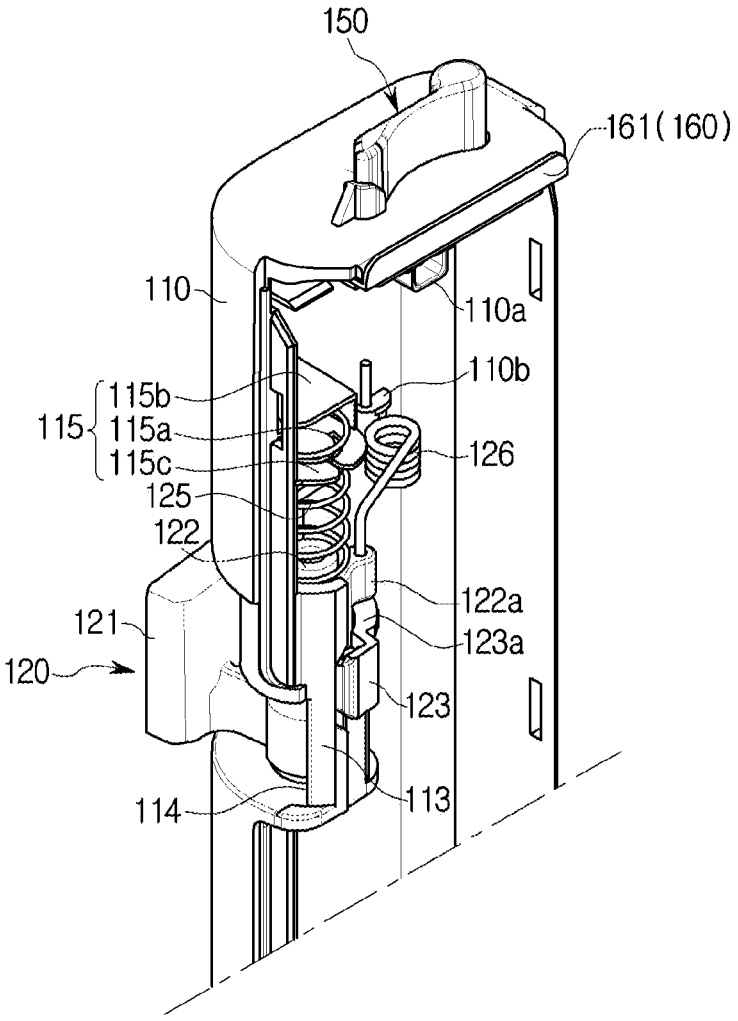
FIG. 8 is a view illustrating an internal state of the rotating bar when the storage compartment is being opened.
Figure 9:
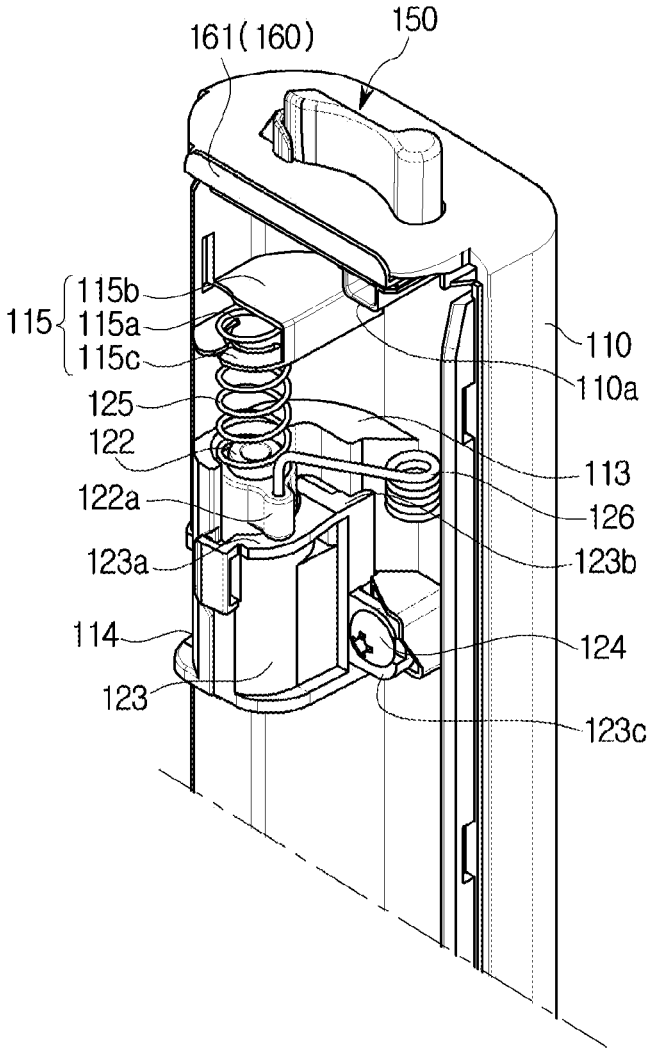
FIG. 9 is a view illustrating the rotating bar shown in FIG. 8 when viewed from above and from the right.
Figure 10:
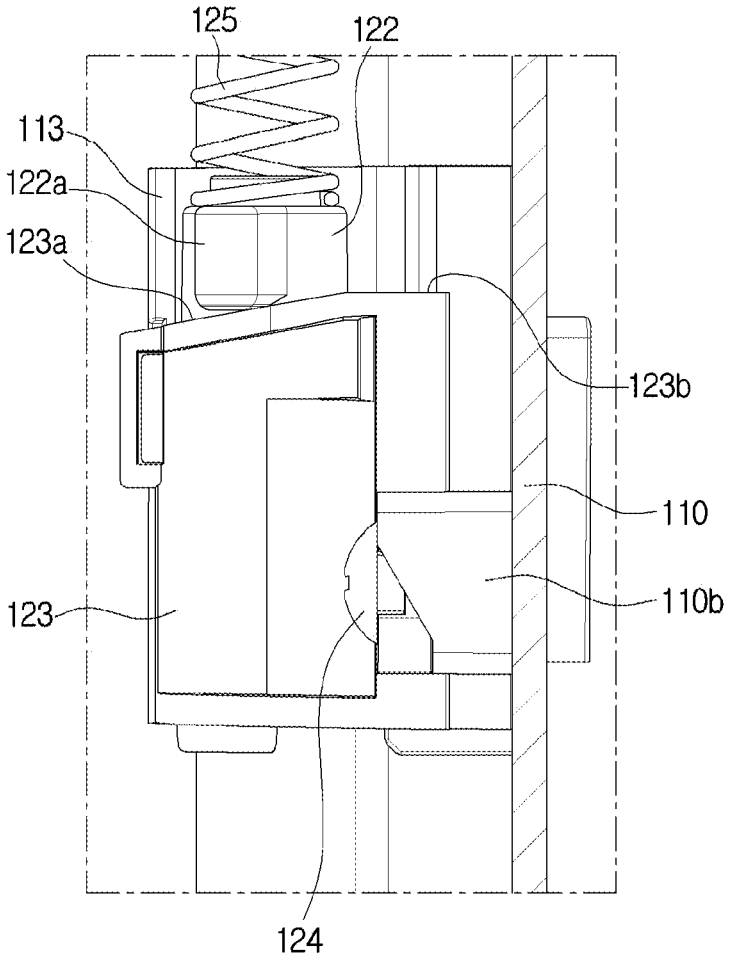
FIG. 10 is a view illustrating a position of the protrusion of the rotating bar shown in FIG. 8.
Figure 11:
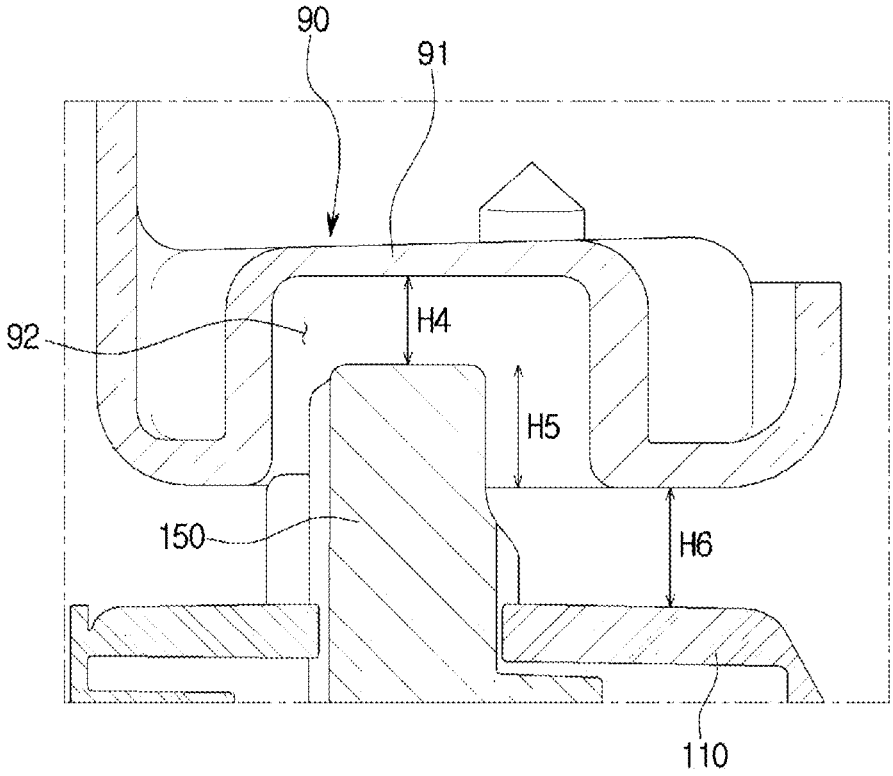
FIG. 11 is a view illustrating a state in which the rotating bar shown in FIG. 3 has entered the guide part.
Figure 12:
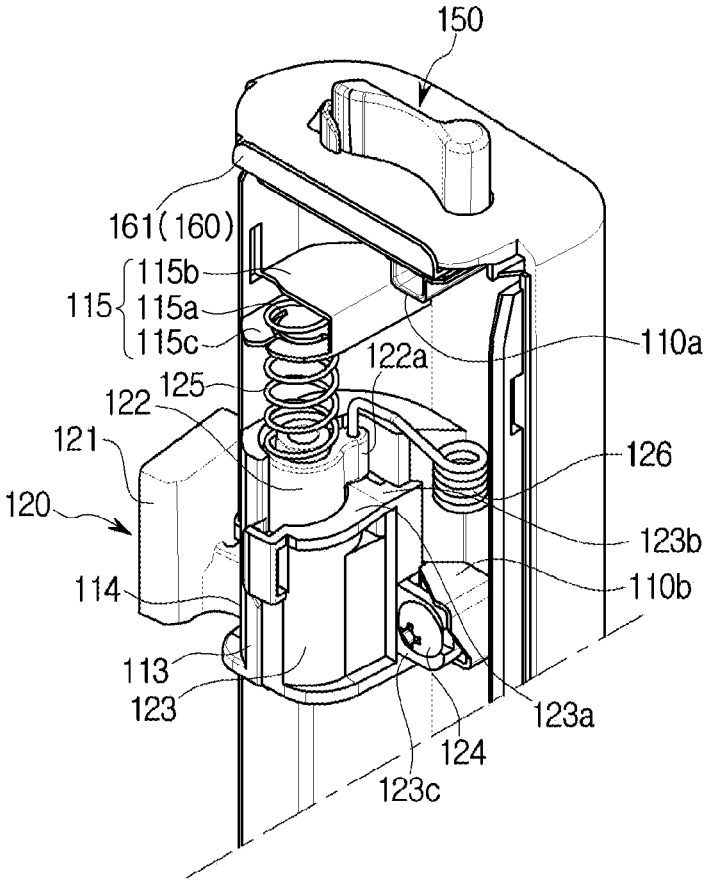
FIG. 12 is a view illustrating an internal state of the rotating bar when the storage compartment is being closed.
Figure 13:
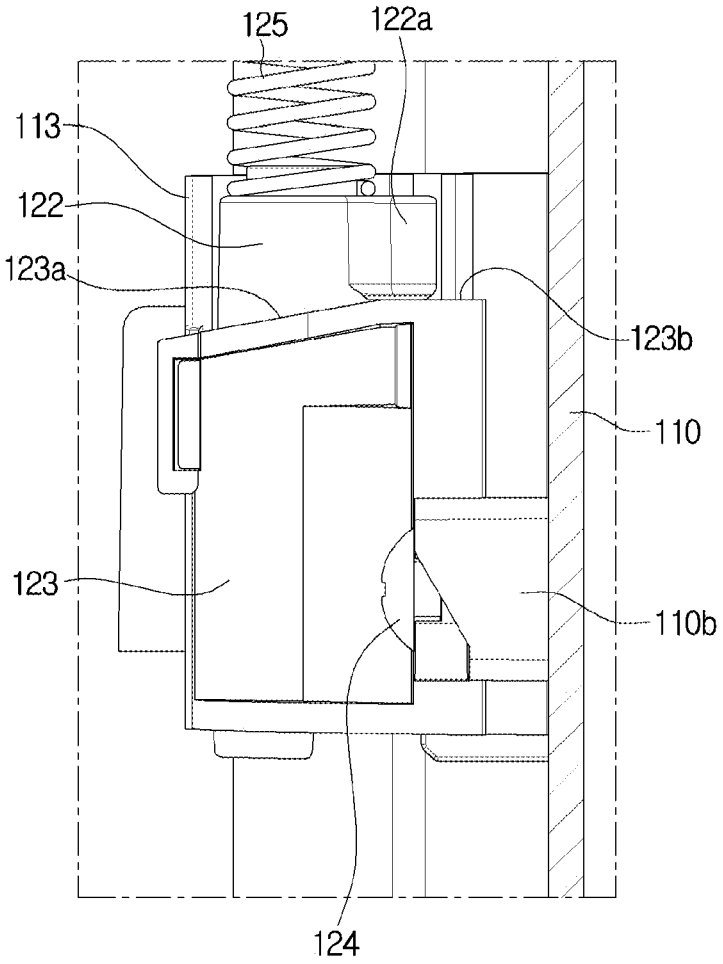
FIG. 13 is a view illustrating a position of the protrusion of the rotating bar shown in FIG. 12.

FIG. 7 is a view illustrating a state in which the rotating bar 100 shown in FIG. 3 enters the guide part 90. FIG. 8 is a view illustrating an internal state of the rotating bar 100 when the storage compartment 21 is being opened. FIG. 9 is a view illustrating the rotating bar 100 shown in FIG. 8 when viewed from above and from the right. FIG. 10 is a view illustrating a position of the protrusion 122*a* of the rotating bar 100 shown in FIG. 8. FIG. 11 is a view illustrating a state in which the rotating bar 100 shown in FIG. 3 has entered the guide part 90. FIG. 12 is a view illustrating an internal state of the rotating bar 100 when the storage compartment 21 is being closed. FIG. 13 is a view illustrating a position of the protrusion 122*a* of the rotating bar 100 shown in FIG. 12.

FIGS. 7 to 10 are views illustrating a case in which the rotating bar 100 is at the first position, and FIGS. 11 to 13 are views illustrating a case in which the rotating bar 100 is at the second position.

In detail, referring to FIGS. 7 to 13, when the case 110 pivots while the upper hinge member 120 is fixed, the upper shaft cover 123 fixed to the case 110 may also pivot in the same direction. Accordingly, a top part of the upper shaft cover 123, which is in contact with the protrusion 122*a*, is also changed. Additionally, an amount of compression of the first elastic member 125 is also changed.

For example, when the rotating bar 100 pivots from the first position to the second position, the upper shaft cover 123 pivots with respect to the protrusion 122*a* such that the protrusion 122*a*, which pressurizes a bottom of the incline portion 123*a*, pressurizes a top of the incline portion 123*a*. Accordingly, a height of the case 110 is lowered. That is, since a height of the protrusion 122*a* of the upper hinge member 120 is fixed, the case 110 is moved downward along the protrusion 122*a* by the incline portion 123*a*. Once the rotating bar 100 has been moved to the second position, the protrusion 122*a* is disposed on the level portion 123*b* and a height of the rotating bar 100 no longer changes.

That is, the level portion 123*b* may be formed to be level to stop downward movement of the rotating bar 100. Additionally, here, the first elastic member 125 is more compressed than in a general compression state.

For example, when the rotating bar 100 pivots from the second position to the first position, the upper shaft cover 123 pivots with respect to the protrusion 122*a* such that the protrusion 122*a*, which pressurizes the top of the incline portion 123*a*, pressurizes the bottom of the incline portion 123*a*. Accordingly, the height of the case 110 is raised. That is, since the height of the protrusion 122*a* of the upper hinge member 120 is fixed, the case 110 is moved upward along the protrusion 122*a* by the incline portion 123*a*. Here, the first elastic member 125 is less compressed than when the rotating bar 100 is located at the second position. That is, the first elastic member 125 may elongate, unlike when the rotating bar 100 is located at the second position.

For example, when the insertion protrusion 150 of the rotating bar 100 enters the guide part 90, a distance H1 between the insertion protrusion 150 and a top surface of the inside of the guide part 90 may be about 0.2 mm, a length H2 of where the insertion protrusion 150 and the guide groove 92 overlap with each other may be about 10.1 mm, and a distance H3 between a bottom end of the guide part 90 and a top end of the case 110 may be about 2 mm.

On the other hand, when the insertion protrusion 150 of the rotating bar 100 has completely entered the guide part 90, the rotating bar 100 may move downward by about 2 mm. Accordingly, a distance H4 between the insertion protrusion 150 and the top surface of the inside of the guide part 90 may be increased to about 2.2 mm, a length H5 of where the insertion protrusion 150 and the guide groove 92 overlap with each other may be reduced to about 8.2 mm, and a distance H6 between the bottom end of the guide part 90 and the top end of the case 110 may be increased to about 4 mm.

Although not shown in the drawings, an incline portion (not shown) may be provided not at the upper shaft cover 123 but at the first hinge accommodation portion 113 of the case 110. In detail, when the protrusion 122*a* protrudes not in the rear of the upper shaft 122 but in a leftward direction of the upper shaft 122, the incline portion 123*a* may be provided at one part of the first hinge accommodation portion 113, which corresponds to the protrusion 122*a*, to be guided by the protrusion 122*a*. In this case, unlike the incline portion 123*a* that inclines downward and frontward with respect to the drawings as shown in FIG. 9 or 12, the incline portion may be formed to incline downward and rearward. That is, the incline portion may be provided to incline downward along a direction in which the rotating bar 100 pivots when rotating from the first position to the second position.

The rotating bar 100 may include the first elastic member 125. The first elastic member 125 may support the body 110, 111, and 112 of the rotating bar 100. The first elastic member 125 may have one end fixed to the support 115 of the case 110 and have the other end opposite to the one end and fixed to the upper shaft 122. The first elastic member 125 may be provided to be in a compressed state between the support 115 and the upper shaft 122. The first elastic member 125 may include a spring.

The first elastic member 125 may be further compressed when the rotating bar 100 is located at the second position than when at the first position.

The first elastic member 125 may support the case 110 in an upward direction with respect to the upper hinge member 120. Accordingly, the first elastic member 125 may prevent the rotating bar 100 from hanging with respect to the doors 30

From another point of view, the first elastic member 125 may support, in a downward direction, the upper shaft 122 of the upper hinge member 120 with respect to the case 110. That is, the first elastic member 125 may pressurize the upper shaft 122 to allow the protrusion 122*a* of the upper shaft 122 to come into close contact with the incline portion 123*a* of the upper shaft cover 123. The first elastic member 125 may be disposed to support the upper shaft 122 to allow the protrusion 122*a* to become closer to the incline portion 123*a*. The first elastic member 125 may pressurize the protrusion 122*a* so that the protrusion 122*a* faces the incline portion 123*a*.

According to the above configuration, the rotating bar 100 may provide reliable height adjustment operation while rotating. That is, the first elastic member 125 may pressurize the protrusion 122*a* in a direction toward the upper shaft cover 123 to allow the protrusion 122*a* to constantly be in contact with the upper shaft cover 123.

One part of the first elastic member 125 may be inserted into the guide hole 115*a*. The guide hole 115*a* may guide compression and/or elongation of the first elastic member 125.

The one part of the first elastic member 125 may be additionally supported by the plate 115*c* disposed therebelow. Accordingly, an intermediate portion of the first elastic member 125 may be prevented from being distorted leftward or rightward.

The rotating bar 100 may include an upper torsion spring 126. The torsion spring 126 may have one end connected to the upper hinge member 120 and the other end, opposite to the one end, connected to the case 110. The torsion spring 126 may apply an elastic force to the rotating bar 100 to allow the rotating bar 100 to smoothly pivot. In detail, the torsion spring 126 may be provided to apply an elastic force to the case 110 in a direction in which the rotating bar 100 pivots when rotating toward the first position or the second position. The lower hinge member 130 may include the lower hinge body 131, the lower connector 131*a*, and the lower shaft 132 provided to be approximately identical to the upper hinge body 121, the upper connector 121*a*, and the upper shaft 122 of the upper hinge member 120.

The rotating bar 100 may include the lower shaft cover 133 for covering the lower shaft 132 accommodated in the second hinge accommodation portion 116. The lower shaft cover 133 may be coupled to the case 110 by a second coupling member 134. The lower shaft cover 133 may, with the second hinge accommodation portion 116 of the case 110, rotatably and slidably support the lower shaft 132. The lower shaft cover 133 and the second hinge accommodation portion 116 may together form a coupling hole with a size corresponding to a size and/or shape of the lower shaft 132.

The second hinge accommodation portion 116 may include a lower opening 117 in which the lower connector 131*a* of the lower hinge member 130 is disposed.

However, the lower hinge member 130, unlike the upper hinge member 120, is not pressurized downward by a component corresponding to the first elastic member 125, and components corresponding to the incline portion 123*a* and the level portion 123*b* may be omitted therefrom.

On the other hand, the lower hinge member 130, like the upper hinge member 120, may be provide to be pressurized downward by a component corresponding to the first elastic member 125, and components corresponding to the incline portion 123*a* and the level portion 123*b* may be provided therein. Accordingly, because of the component corresponding to the first elastic member 125, the bottom end of the case 110, where the lower hinge member 130 is provided, may also be supported in an upward direction and simultaneously be supported in a downward direction when the rotating bar 100 pivots.

The intermediate hinge member 140, with the upper hinge member 120 and/or the lower hinge member 130, may rotatably support the case 110. The intermediate hinge member 140 may include an intermediate hinge body 141 fixed to the first doors 30 and an intermediate shaft 142 rotatably and slidably coupled to the case 110.

Referring to FIGS. 4 and 5, the rotating bar 100 may include the insertion protrusion 150 inserted in the guide groove 92 of the guide part 90. The insertion protrusion 150 may at least partially protrude outward from the case 110 through the through hole 119 of the case 110. The insertion protrusion 150 may be guided by the guide part 90 and may be guided such that at least one part thereof protrudes outward from the case 110.

The insertion protrusion 150 may enter the guide groove 92 and may pivot along a curved surface of the guide groove 92. As the insertion protrusion 150 pivots, the rotating bar 100 may pivot. That is, during a process in which the first doors 30 are closed, the rotating bar 100 pivots from the first position vertical to the first doors 30 to the second position parallel to the first doors 30.

The insertion protrusion 150 may be elastically supported by a second elastic member 151. The second elastic member 151 may elastically support the insertion protrusion 150 outside the case 110.

In detail, when the insertion protrusion 150 collides with the guide body 91 of the guide part 90 because the first doors 30 are hanging or the height of the rotating bar 100 is abnormal due to an unevenness of the floor surface on which the refrigerator 1 is installed, the insertion protrusion 150 may move into the case 110 to allow the rotating bar 100 to be rotatable. The second elastic member 151 may have one end fixed to a support 110*a* of the case 110 and the other end opposite to the one end fixed to the insertion protrusion 150.

Meanwhile, sealing members 160 for sealing a gap between the rotating bar 100 and the housing 10 when the first doors 30 are closed may be provided at a top end and a bottom end of the rotating bar 100. The sealing member 160 may include an upper sealing member 161 and a lower sealing member 162. The upper sealing member 161 may seal a gap between the guide part 90 and the rotating bar 100, and the lower sealing member 162 may seal a gap between the housing 10 and the rotating bar 100.

Figure 14:
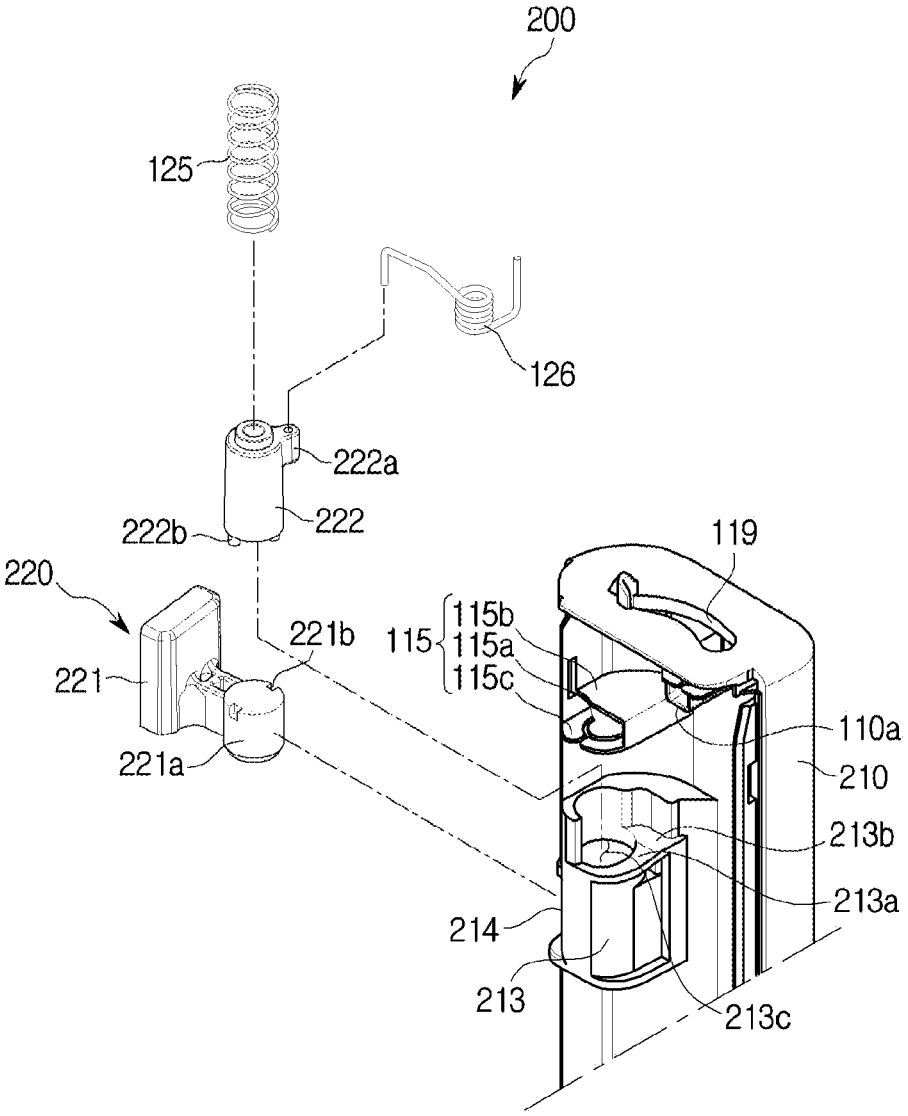
FIG. 14 is an exploded perspective view illustrating a configuration of a rotating bar according to another embodiment.

FIG. 14 is an exploded perspective view illustrating a configuration of a rotating bar 200 according to another embodiment.

The rotating bar 200 according to another embodiment will be described with reference to FIG. 14. Components the same those of the above-described embodiment will be referred to using the same reference numerals, and a description thereof will be omitted.

An upper hinge member 220 of the rotating bar 200 according to another embodiment may include an upper hinge body 221 and an upper shaft 222.

The upper hinge body 221, unlike the embodiment shown in FIGS. 3 to 13, may be integrated with a rotating shaft portion that forms a part of a rotating shaft of the case 210. The rotating shaft portion 221*a* may be smaller than a size of an upper opening 214. A coupling groove 221*b* into which a coupling protrusion 222*b* of an upper shaft 222, which will be described below, is inserted may be formed at the rotating shaft portion 221*a*.

The upper shaft 222 may include a protrusion 222*a* and the coupling protrusion 222*b* that protrudes downward. Since the protrusion 222*a* includes the same configuration and function as those of the protrusion 122*a* shown in FIGS. 3 to 13, a detailed description thereof will be omitted.

According to the above components, in the rotating bar 200 according to another embodiment, the upper hinge body 221 is inserted into a first hinge accommodation portion 213 through the upper opening 214 and the upper shaft 222 is inserted into the first hinge accommodation portion 213 through an upper hinge opening 213*c* formed at a top of the first hinge accommodation portion 213 such that assemblage may be improved. The rotating shaft portion 221*a* of the upper hinge body 221 and the upper shaft 222 may pivot together due to mutual coupling between the coupling protrusion 222*b* and the coupling groove 221*b*.

Additionally, due to the above configuration, it is unnecessary to additionally provide a component like the upper shaft cover 123 separately coupled to the case 110 in the embodiment shown in FIGS. 3 to 13, and the upper shaft cover 213 may be formed to be integrated with the case 210 in the embodiment shown in FIG. 14. The upper shaft cover 213 may include an incline portion 213*a* and a level portion 213*b*.

Figure 15:
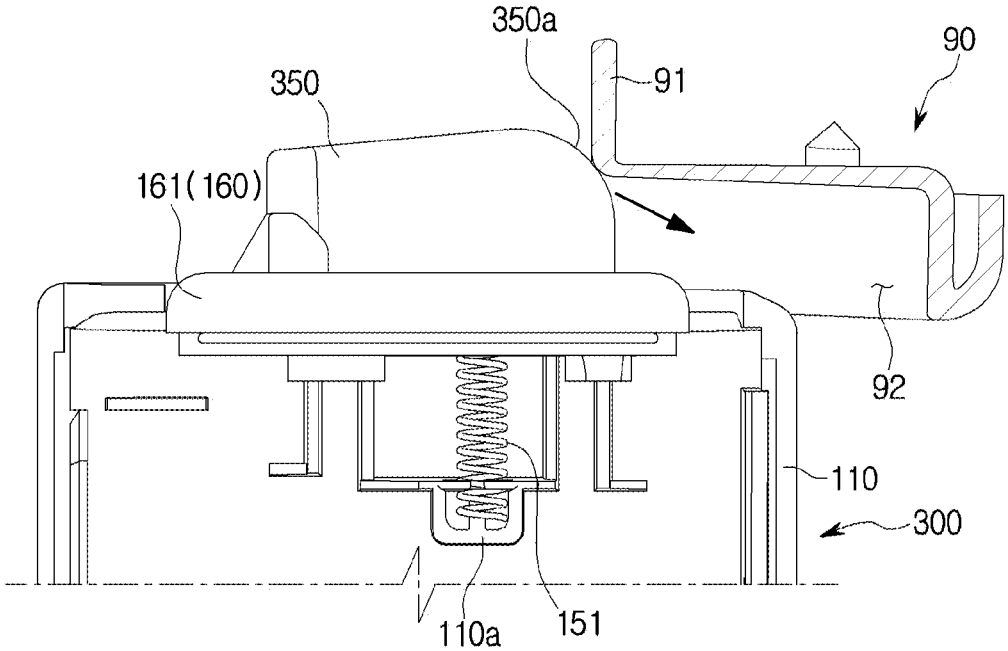
FIG. 15 is a view illustrating a state in which a rotating bar according to still another embodiment enters the guide part.
Figure 16:
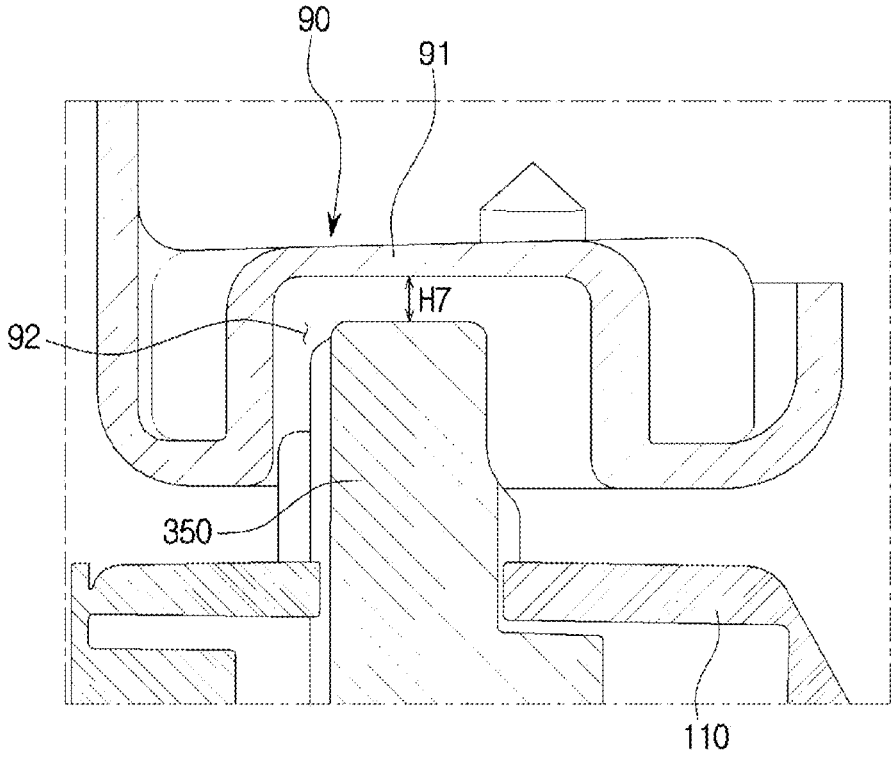
FIG. 16 is a view illustrating a state in which the rotating bar shown in FIG. 15 has entered the guide part.

FIG. 15 is a view illustrating a state in which a rotating bar 300 according to still another embodiment enters the guide part 90. FIG. 16 is a view illustrating a state in which the rotating bar 300 shown in FIG. 15 has entered the guide part 90. The rotating bar 300 according to still another embodiment will be described with reference to FIGS. 15 and 16. Components the same as those of the above-described embodiments will be referred to using the same reference numerals, and a description thereof will be omitted.

An insertion protrusion 350 of the rotating bar 300 according to still another embodiment may include a protrusion incline 350*a* formed on one side according to a direction of entry into the guide part 90.

When a position of the rotating bar 300 is raised due to a state of the floor surface on which the refrigerator 1 is disposed, the insertion protrusion 350 contacts the guide part 90 such that the rotating bar 300 may not pivot even when the first doors 30 close the first storage compartment 21.

To prevent this, the insertion protrusion 350 of the rotating bar 300 according to another embodiment may include the protrusion incline 350*a* formed at one surface, which faces the guide part 90, to be inclined downward along a direction that faces the guide part 90 when the rotating bar 300 is located at a first position.

The protrusion incline 350*a* may allow, even when the insertion protrusion 350 collides with the guide part 90, the insertion protrusion 350 to move downward along a direction of the arrow and enter the guide groove 92 as the second elastic member 151 is compressed. The insertion protrusion 350 may be provided to be movable into the case 110 by pressurizing the guide part 90 when the protrusion incline 350*a* collides with the guide part 90.

In addition, since, like the rotating bar 100 according to one embodiment shown in FIGS. 3 to 13, the rotating bar 300 according to still another embodiment shown in FIGS. 15 and 16 pivots from a first position to a second position, lowering a height thereof, the insertion protrusion 350 may be spaced a certain distance H7 apart from the top surface of the inside of the guide body 91 while rotating inside the guide groove 92. Accordingly, the rotating bar 300 may smoothly pivot.

Figure 17:
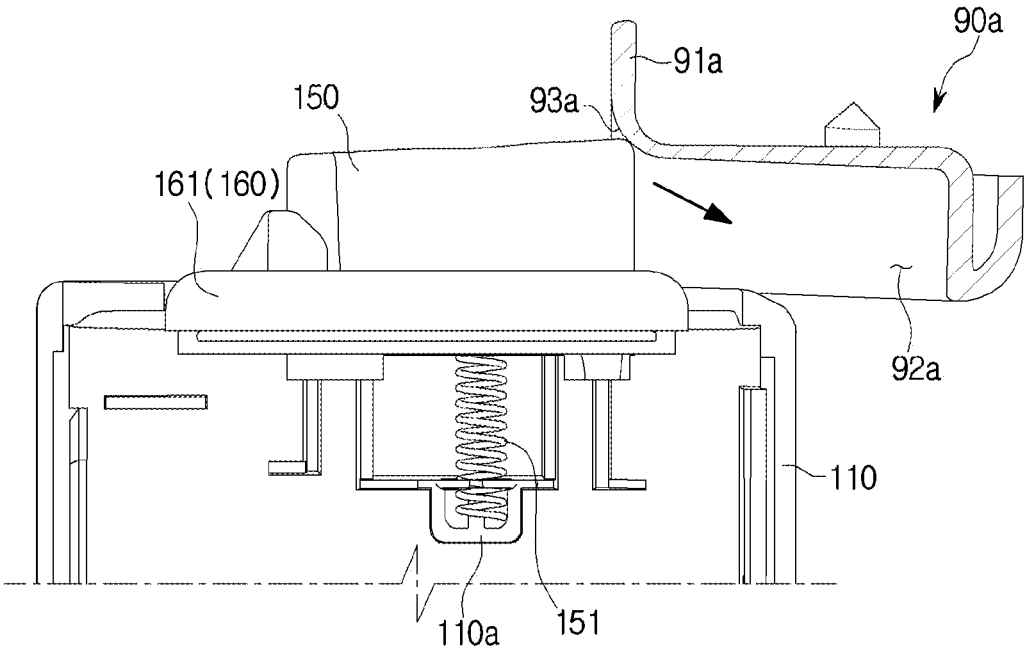
FIG. 17 is a view illustrating a state in which the rotating bar shown in FIG. 3 enters a guide part according to another embodiment.

FIG. 17 is a view illustrating a state in which the rotating bar 100 shown in FIG. 3 enters a guide part 90*a* according to another embodiment.

The guide part 90*a* according to another embodiment will be described with reference to FIG. 17. Components the same as those of the above-described embodiments will be referred to using the same reference numerals, and a description thereof will be omitted.

The guide part 90*a* according to another embodiment may include a guide incline 93*a* for guiding the insertion protrusion 150 downward when the rotating bar 100 has moved upward like the rotating bar 300 in the embodiment shown in FIGS. 15 and 16. The guide part 90*a* may include the guide incline 93*a* formed at one part where the insertion protrusion 150 enters and formed to be inclined downward along an entry direction of the insertion protrusion 150.

That is, unlike in the embodiment shown in FIGS. 15 and 16 in which the protrusion incline 350*a* is formed at the insertion protrusion 350, in the embodiment shown in FIG. 17, the guide incline 93*a* may be formed at a guide body 91*a* of the guide part 90*a* to guide the entrance of the insertion protrusion 150. The insertion protrusion 150 may smoothly enter a guide groove 92*a* due to the guide incline 93*a* even when the position of the rotating bar 100 is raised. The insertion protrusion 150 may be movable into the case 110 by pressurizing the guide part 90*a* when colliding with the guide incline 93*a*.

As is apparent from the above description, since a refrigerator includes a rotating bar whose height with respect to a housing is changed as rotating occurs with respect to a door, even when the door hangs or the floor on which the refrigerator is disposed is inclined such that a position of the rotating bar is changed, the rotating bar may be smoothly guided by a guide part.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a housing comprising a storage compartment;

a first door and a second door configured to open or close the storage compartment;

a rotating bar rotatably mounted to the first door and configured to cover a gap formed between the first door and the second door while the first door and the second door close the storage compartment; and a guide part provided at the housing and configured to guide rotating of the rotating bar, wherein the rotating bar is located at:

a first position vertical to the first door when the first door opens the storage compartment, and a second position parallel to the first door and lower in relation to the door than the first position when the first door closes the storage compartment; and wherein the rotating bar comprises:

a hinge member accommodated in a hinge accommodation portion of the rotating bar and including:

a shaft configured to allow the rotating bar to rotate between the first position and the second position; and a protrusion radially protruded from the shaft; and a shaft cover configured to cover the shaft of the hinge member and including an incline portion formed to incline downward along a direction in which the rotating bar rotates when pivoting from the first position to the second position, wherein the protrusion slides downwardly on the incline portion while the rotating bar pivots from the first position to the second position, the rotating bar is lowered in height and guided by the guide part to rotate.

2. The refrigerator of claim 1, wherein the rotating bar comprises:

a body rotatably coupled to the hinge member; and a first elastic member of which one end is connected to the hinge member and another end, opposite to the one end, is connected to the body.

3. The refrigerator of claim 2, wherein the first elastic member is disposed to support the body upward with respect to the hinge member.

4. The refrigerator of claim 3, wherein:

the hinge member comprises an upper hinge member coupled to a top of the first door, and the first elastic member is disposed to allow the one end thereof to be connected to the hinge member to support the body.

5. The refrigerator of claim 4, wherein the body comprises a support that is located in a manner to be connected to another end of the first elastic member, which is opposite to the one end, and is supported by the first elastic member.

6. The refrigerator of claim 5, wherein the support comprises a guide hole configured to guide compression or elongation of the first elastic member.

7. The refrigerator of claim 3, wherein:

the rotating bar comprises:

an insertion protrusion guided by the guide part and with at least one part supported so as to protrude outward from the body; and a second elastic member configured to elastically support the insertion protrusion outside the body, and the insertion protrusion comprises a protrusion incline formed on one surface that faces the guide part and formed to incline downward toward the guide part when the rotating bar is located at the first position.

8. The refrigerator of claim 7, wherein the insertion protrusion is provided to be movable into the body by pressurizing of the guide part when the protrusion incline collides with the guide part.

9. The refrigerator of claim 3, wherein:

the rotating bar comprises:

an insertion protrusion guided by the guide part and with at least one part supported so as to protrude outward from the body; and a second elastic member configured to elastically support the insertion protrusion outside the body, and the guide part comprises a guide incline formed at one portion where the insertion protrusion enters and formed to incline downward along an entrance direction of the insertion protrusion.

10. The refrigerator of claim 9, wherein the insertion protrusion is provided to be movable into the body by pressurizing the guide part when colliding with the guide incline.

11. The refrigerator of claim 1, wherein the first elastic member is disposed to pressurize the shaft to allow the protrusion to come into contact with the incline portion.

12. The refrigerator of claim 1, wherein the protrusion is configured to:

pressurize a bottom of the incline portion when the rotating bar is located at the first position, and pressurize a top of the incline portion when the rotating bar is located at the second position.

13. The refrigerator of claim 1, wherein the shaft cover is separably coupled to the body.

14. A refrigerator comprising:

a housing comprising a storage compartment;

a door configured to open or close the storage compartment;

a rotating bar provided at the door to be rotatable and with a height that changes as the door opens or closes the storage compartment; and a guide bar provided at the housing and configured to guide rotating of the rotating bar, wherein the rotating bar comprises:

a shaft cover comprising an incline portion formed to incline downward along a direction in which the rotating bar rotates when the door closes the storage compartment; and a hinge member fixed to the door and comprising a shaft with a protrusion that slides on the incline portion when the rotating bar rotates.

15. The refrigerator of claim 14, wherein the rotating bar comprises a first elastic member configured to pressurize the protrusion in a direction toward the incline portion.

16. The refrigerator of claim 14, wherein the rotating bar moves downward when the door closes the storage compartment.

17. The refrigerator of claim 16, wherein the shaft cover comprises a level portion formed to be level to stop downward movement of the rotating bar.

18. A refrigerator comprising:

a housing comprising a storage compartment;

a first door and a second door configured to open or close the storage compartment;

a rotating bar rotatably mounted to the first door and configured to:

cover a gap formed between the first door and the second door while the first door and the second door close the storage compartment, pivot parallel to the first door and move downward when the first door and the second closes the storage compartment, and pivot vertical to the first door and move upward when the first door opens the storage compartment; and a guide part configured to guide rotating of the rotating bar, wherein the rotating bar comprises:

a hinge member accommodated in a hinge accommodation portion of the rotating bar and including:

a shaft configured to allow the rotating bar to rotate; and a protrusion radially protruded from the shaft; and a shaft cover configured to cover the shaft and including an incline portion formed to incline downward along a direction in which the rotating bar rotates when the rotating bar pivots parallel to the first door, wherein the protrusion slides downwardly on the incline portion while the rotating bar pivots parallel to the first door, the rotating bar is lowered in height and guided by the guide part to pivot.

* * * * *